US010059555B2

(12) United States Patent
Yoda et al.

(10) Patent No.: US 10,059,555 B2
(45) Date of Patent: Aug. 28, 2018

(54) SHEET STACKING APPARATUS AND IMAGE FORMING APPARATUS

(71) Applicant: CANON FINETECH NISCA INC., Misato-shi (JP)

(72) Inventors: Ichiro Yoda, Minamikoma-gun (JP); Kazuhiko Watanabe, Minamikoma-gun (JP); Hiroshi Amano, Minamikoma-gun (JP); Shintaro Moriya, Minamikoma-gun (JP); Seiji Ono, Minamikoma-gun (JP); Masao Ueno, Minamikoma-gun (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/427,407

(22) Filed: Feb. 8, 2017

(65) Prior Publication Data

US 2017/0235270 A1 Aug. 17, 2017

(30) Foreign Application Priority Data

Feb. 15, 2016 (JP) ..... 2016-026094

(51) Int. Cl.

| | |
|---|---|
| ***B65H 31/10*** | (2006.01) |
| ***B65H 43/06*** | (2006.01) |
| ***B65H 43/08*** | (2006.01) |

(52) U.S. Cl.
CPC ..... *B65H 31/10* (2013.01); *B65H 43/06* (2013.01); *B65H 43/08* (2013.01)

(58) Field of Classification Search
CPC ..... B65H 31/10; B65H 43/06; B65H 43/08
See application file for complete search history.

(56) References Cited

U.S. PATENT DOCUMENTS 4,229,650 A * 10/1980 Takahashi ..... B65H 31/10 250/223 R
9,708,149 B2 * 7/2017 Arai ..... B65H 43/02

FOREIGN PATENT DOCUMENTS

JP 11-199114 A 7/1999

* cited by examiner

*Primary Examiner* — David H Bollinger
(74) *Attorney, Agent, or Firm* — Fitzpatrick, Cella, Harper & Scinto

(57) ABSTRACT

A sheet stacking apparatus includes a movable stack portion on which sheets are to be stacked; a detection portion configured to detect whether or not a topmost sheet of sheets stacked on the stack portion is positioned at a predetermined position; and a control portion configured to position the topmost sheet at the predetermined position based on a detection result of the detection portion. In a case where the control portion moves the stack portion at a first speed so that a topmost sheet on the stack portion deviates from the predetermined position, the control portion moves the stack portion at a second speed lower than the first speed to position the topmost sheet at the predetermined position.

13 Claims, 10 Drawing Sheets

SHEET STACKING APPARATUS AND IMAGE FORMING APPARATUS

BACKGROUND OF THE INVENTION

Field of the Invention

The present invention relates to a sheet stacking apparatus configured to sequentially stack delivered sheets, and an image forming apparatus comprising the sheet stacking apparatus.

Description of the Related Art

Hitherto, a sheet stacking apparatus includes a stack tray on which delivered sheets are sequentially stacked, a raising and lowering portion configured to raise and lower the stack tray, an upper-surface detection sensor configured to detect an upper surface of a topmost sheet of the sheets stacked on the stack tray, and a control portion configured to control the raising and lowering portion based on a result of detection so that the upper surface of the sheets stacked on the stack tray is controlled to be constantly positioned at a predetermined height level.

In this type of sheet stacking apparatus, however, when a large number of sheets are removed from the stack tray, a position of the topmost sheet on the stack tray is lowered. Therefore, when a subsequently delivered sheet is introduced to the stack tray, a distance over which the sheet falls increases. As a result, there is a fear of failure in sheet delivery and failure in sheet stacking.

Thus, there has been known a sheet stacking apparatus further including a second sensor configured to detect removal of a part of a bundle of sheets from a stack tray. The sheet stacking apparatus moves the stack tray by a raising and lowering portion based on the detection result of the second sensor so that the stack tray returns to an appropriate sheet delivery position (Japanese Patent Application Laid-Open No. H11-199114).

FIG. 8 is a front view for illustrating a first sensor 100, a second sensor 200, and a stack tray 400 in a related-art sheet stacking apparatus. The first sensor 100 is a transmission sensor including a light-receiving portion 100*a*, and the second sensor 200 is a transmission sensor including and a light-receiving portion 200*a*. The first sensor 100 and the second sensor 200 share a light-emitting portion 300.

The first sensor 100 forms a first optical axis L1 between the light-receiving portion 100*a* and the light-emitting portion 300 respectively mounted to an upper part of a left side and an upper part of a right side of the stack tray 400. The light-receiving portion 100*a* and the light-emitting portion 300 are arranged so that the optical axis L1 becomes parallel to a rear edge of a bundle of sheets S in a state of being well-stacked on the stack tray 400.

The second sensor 200 forms a second optical axis L2 between the light-receiving portion 200*a* and the light-emitting portion 300. The light-receiving portion 200*a* of the second sensor 200 is arranged below the light-receiving portion 100*a* of the first sensor 100. Therefore, the optical axis L2 of the second sensor 200 is set at an angle with respect to the horizontal optical axis L1 of the first sensor 100.

The first sensor 100 is used to lower the stack tray 400 until the optical axis L1 is restored after the optical axis L1 is interrupted by a bundle of sheets S stacked on the stack tray 400. On the other hand, the second sensor 200 is used to raise the stack tray 400 until the optical axis L2 is interrupted again after the bundle of sheets S on the stack tray 400 is partially or entirely removed to open the interrupted optical axis L2.

With the sensor configuration described above, however, when the sheet introduced to the stack tray 400 has a curled edge or has a partially swelled edge through a binding process, a surface of the sheet is not level. Therefore, the sheet cannot be detected at an appropriate timing. As a result, there arises a fault that raising and lowering control of the stack tray 400 is adversely affected.

More specifically, the above-mentioned fault will be described referring to FIG. 9A to FIG. 9F. FIG. 9A to FIG. 9F are explanatory diagrams of the fault occurring during the raising and lowering operation of the stack tray according to the related art. FIG. 9B, FIG. 9D, and FIG. 9F are side views of the stack tray 400 on which the sheets delivered by delivery rollers 71 in a direction indicated by an arrow A are stacked. FIG. 9A, FIG. 9C, and FIG. 9E are front views of the stack tray 400 as viewed from a direction opposite to the direction indicated by the arrow A of FIG. 9B, FIG. 9D, and FIG. 9F, respectively.

In FIG. 9A and FIG. 9B, a height level of an upper surface of the bundle of sheets S stacked on the stack tray 400 is positioned between the light-receiving portion 100*a* and the light-receiving portion 200*a*. Therefore, the bundle of sheets S is positioned sufficiently below the optical axis L1. Hence, the optical axis L1 is not interrupted even when a subsequent sheet is stacked thereon, and therefore the stack tray 400 is not lowered. Further, the optical axis L2 is interrupted by the bundle of sheets S. Unless the optical axis L2 is opened by removing the bundle of sheets S entirely or partially, the stack tray 400 is not raised.

When a sheet of which a surface is not level and swells along inclination of the optical axis L2, for example, a sheet C having a curled rear edge is introduced in the above-mentioned sheet stacking state, the curled portion interrupts the optical axis L1. As a result, a lowering operation of the stack tray 400 is performed.

Then, when the curled portion of the sheet C deviates from the optical axis L1, a drive to lower the stack tray 400 is stopped. However, the lowering is continued by inertia for a while (FIG. 9C and FIG. 9D).

At this time, the sheet C has the curled portion to result in the uneven surface, and therefore has an approximately triangular large interruption region P that interrupts the optical axis L2. Therefore, when the lowering is perfectly completed, an upper surface of the sheet C reaches a position at which the optical axis L2 of the second sensor 200 is opened (FIG. 9E and FIG. 9F). Thus, the bundle of sheets S is regarded as having been removed from the stack tray 400. As a result, a raising operation of the stack tray 400 is performed.

When the optical axis L2 is interrupted again by the curled portion through the raising of the stack tray 400, the drive to raise the stack tray 400 is stopped (FIG. 9C and FIG. 9D). Even at this time, the raising is continued by inertia for a while, and the curled portion interrupts the optical axis L1 again (FIG. 9A and FIG. 9B). Then, the lowering operation of the stack tray 400 is restarted. Subsequently, there is brought about a loop operation in which the lowering and the raising of the stack tray 400 described above are repeated, resulting in an erroneous operation that a topmost sheet stacked on the stack tray 400 as the stack portion cannot be positioned at a predetermined position.

SUMMARY OF THE INVENTION

In view of the disadvantages of the related-art apparatus described above, the present invention provides a sheet stacking apparatus configured to suppress a fault in a raising and lowering operation of a stack portion even when a sheet is detected by a first optical axis and a second optical axis inclined at a predetermined angle with respect to the first optical axis, and an image forming apparatus comprising the sheet stacking apparatus.

In order to solve the above-mentioned problems, according to one embodiment of the present invention, there is provided a sheet stacking apparatus, comprising:

a stack portion, which is movable and on which sheets are to be stacked;

a detection portion configured to detect whether or not a topmost sheet of sheets stacked on the stack portion is positioned at a predetermined position in accordance with whether or not a first optical axis is interrupted by a sheet and whether or not a second optical axis inclined at a predetermined angle with respect to the first optical axis is interrupted by a sheet; and a control portion configured to position a topmost sheet of sheets stacked on the stack portion at the predetermined position based on a detection result of the detection portion, wherein in a case where the control portion moves the stack portion at a first speed so that a topmost sheet of sheets stacked on the stack portion deviates from the predetermined position, the control portion moves the stack portion at a second speed lower than the first speed to position the topmost sheet at the predetermined position.

According to one embodiment of the present invention, there is provided an image forming apparatus comprising the sheet stacking apparatus.

Further features of the present invention will become apparent from the following description of exemplary embodiments with reference to the attached drawings.

DESCRIPTION OF THE EMBODIMENTS

Now, with reference to the accompanying drawings, embodiments of the present invention will be described in detail.

First, an image forming apparatus 110 including a sheet stacking apparatus 120 according to the embodiment will be described.

Figure 1:
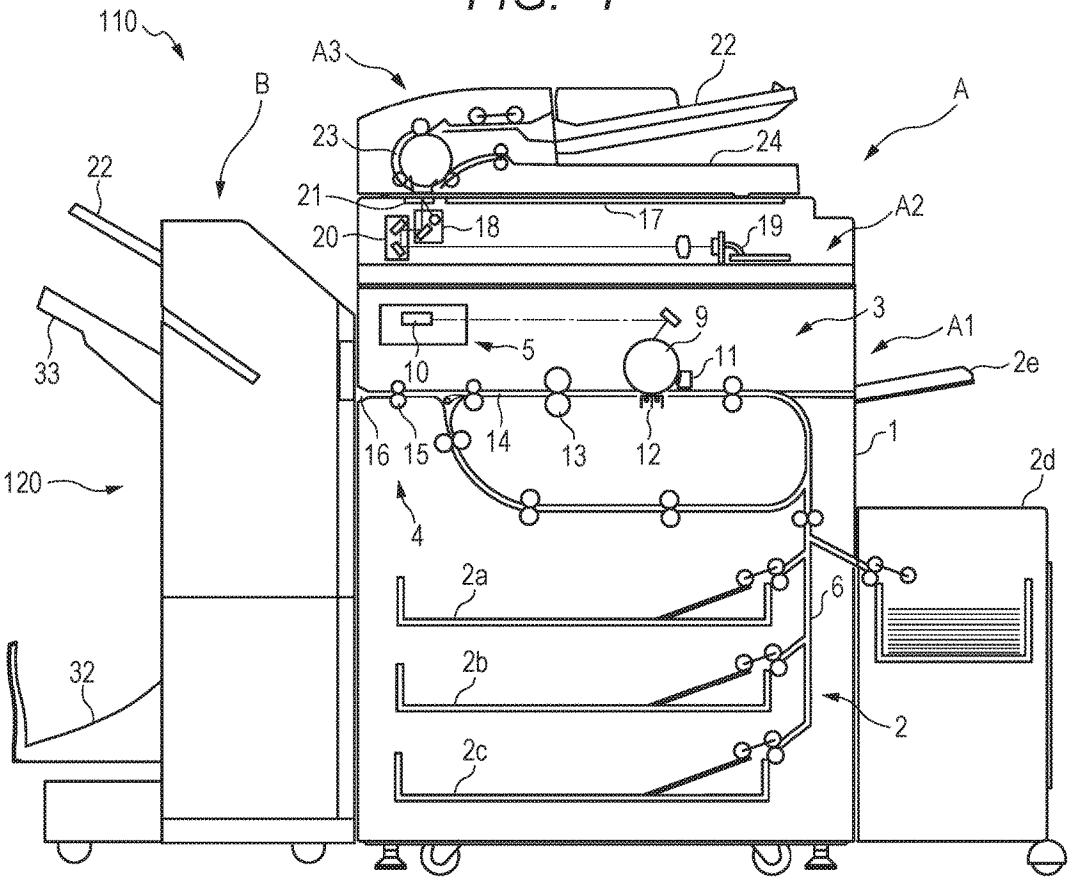
FIG. 1 is an explanatory view of an image forming apparatus including a sheet stacking apparatus.

As illustrated in FIG. 1, the image forming apparatus 110 includes an image forming apparatus main body A and a sheet post-processing apparatus B juxtaposed to the image forming apparatus main body A. The image forming apparatus main body A includes an image forming unit A1, a scanner unit A2, and a feeder unit A3. In an apparatus housing 1, there are provided a sheet feeding portion 2, an image forming portion 3, a sheet delivery portion 4, and a data processing portion 5.

The sheet feeding portion 2 includes cassette mechanisms 2*a*, 2*b*, and 2*c* configured to receive sheets of a plurality of sizes to be subjected to image formation, respectively, and sends out sheets having a size designated by a main body control portion (not shown) to a sheet feeding passage 6. The sheet feeding passage 6 is configured to feed a sheet supplied from each of the cassette mechanisms 2*a*, 2*b*, and 2*c* to a downstream side. Further, a large capacity cassette 2*d* and a manual feed tray 2*e* are connected to the sheet feeding passage 6. The sheet feeding passage 6 is configured to send out sheets respectively supplied from the large capacity cassette 2*d* and the manual feed tray 2*e* in the same manner.

The image forming portion 3 is constructed by, for example, an electrostatic printing mechanism, and includes a photosensitive drum 9 to be rotated. At the periphery of the photosensitive drum 9, there are provided a light emitting unit 10 configured to emit an optical beam, a developing unit 11, and a cleaner (not shown). The image forming portion 3 having a monochromatic printing mechanism is illustrated in FIG. 1. A latent image is optically formed on the photosensitive drum 9 by the light emitting unit 10, and the developing unit 11 causes toner to adhere on the latent image.

Then, a sheet is fed from the sheet feeding passage 6 to the image forming portion 3 at a timing of forming an image on the photosensitive drum 9, and an image is transferred onto the sheet by a transfer charger 12 to be fixed by a fixing roller 13 arranged on a sheet delivery passage 14. On the sheet delivery passage 14, there are arranged a sheet delivery roller 15 and a sheet delivery port 16 to convey the sheet to the sheet post-processing apparatus B described later.

The scanner unit A2 includes a platen 17 configured to place an image original, a carriage 18 configured to reciprocate along the platen 17, a photoelectric converter 19, and a reduction optical system 20 configured to guide light, which is reflected from the original placed on the platen 17 by the carriage 18, to the photoelectric converter 19. Further, the scanner unit A2 includes a running platen 21 and reads a sheet, which is fed from the feeder unit A3, with use of the carriage 18 and the reduction optical system 20. The photoelectric converter 19 is configured to convert optical output from the reduction optical system 20 into image data through photoelectric conversion and output the image data as an electric signal to the image forming portion 3.

The feeder unit A3 includes a feeding tray 22, a feeding passage 23 configured to guide a sheet fed from the feeding tray 22 to the running platen 21, and a delivery tray 24 configured to receive the original whose image is read by the platen.

Figure 2:
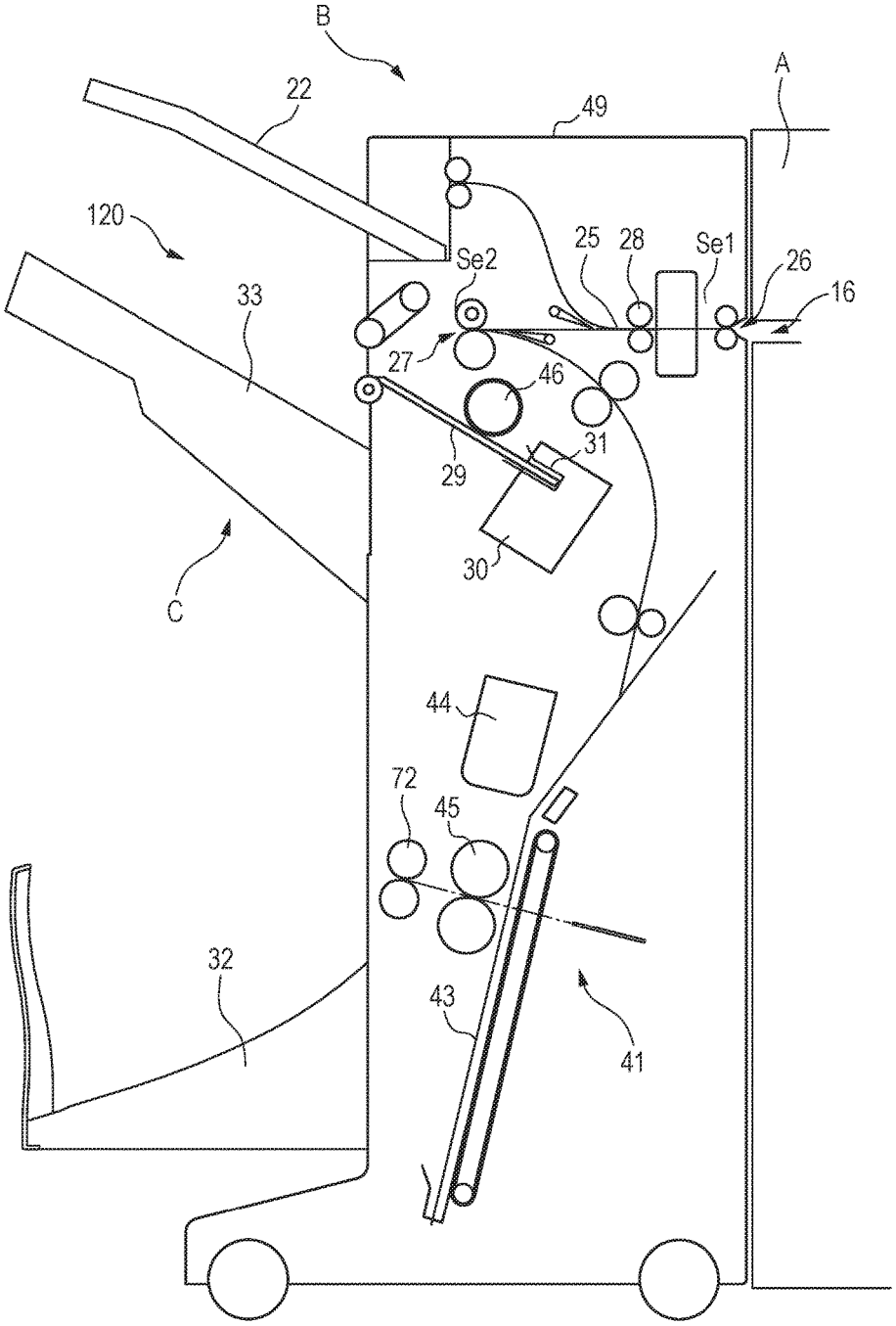
FIG. 2 is an explanatory view of the sheet stacking apparatus.

FIG. 2 is an illustration of a configuration of the sheet post-processing apparatus B configured to perform post-processing on a sheet, which is conveyed from the image forming apparatus main body A and has an image formed thereon. The sheet post-processing apparatus B includes a conveyance passage 25 communicating with the sheet delivery port 16 of the image forming apparatus main body A, and a processing tray 29 and a stack tray 33 arranged on a downstream side of the conveyance passage 25 in the stated order. An inlet sensor Se1 configured to detect a leading edge of a sheet is arranged at a carry-in port 26 of the conveyance passage 25, whereas a sheet delivery sensor Se2 is arranged at a sheet delivery port 27. The sheet is conveyed from the carry-in port 26 to the sheet delivery port 27 by a conveying portion, e.g., conveyance rollers 28.

The processing tray 29 is arranged on a downstream side of the sheet delivery port 27 so as to form a step, and is configured to align and stack sheets conveyed from the conveyance passage 25. A stapler unit 30 is provided to the processing tray 29, and is configured to stack the sheets positioned by a regulation stopper 31 and perform binding on the stacked sheets.

The stack tray 33 being a sheet stack portion is arranged on a downstream side of the processing tray 29. The stack tray 33 is configured to receive the sheets from the conveyance passage 25 and is also arranged to have such a positional relationship that a bundle of sheets bound on the processing tray 29 is received.

Figure 3:
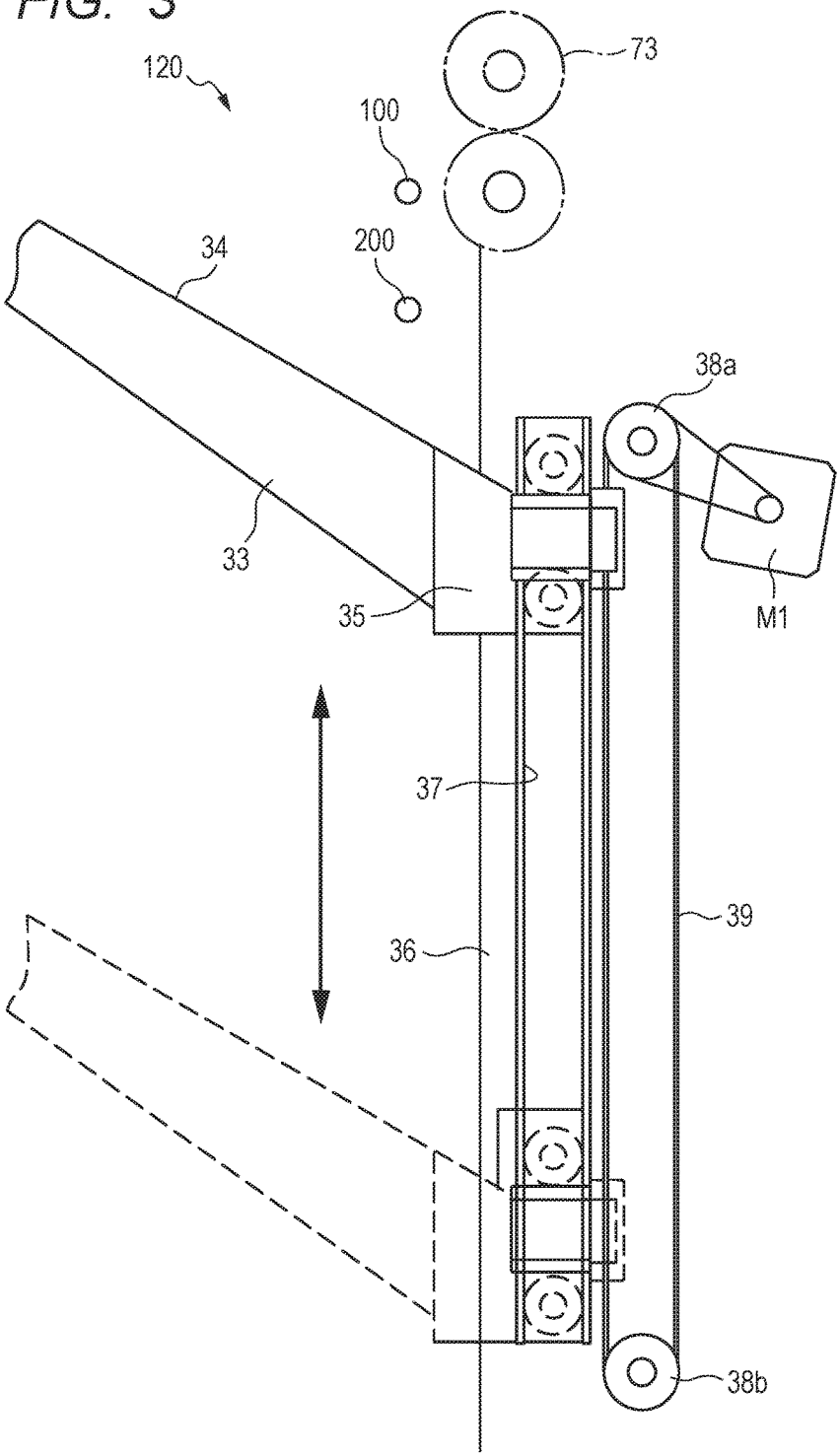
FIG. 3 is an explanatory view of a raising and lowering mechanism for a stack tray.

The structure of the stack tray 33 will be described referring to FIG. 3. The stack tray 33 includes a tray member having a sheet placement surface 34 on which the sheets are placed and a tray base 35 configured to mount (fix) the tray member. The tray member and the tray base 35 are supported on a guide rail 37 arranged on an apparatus frame 36 so as to be vertically movable in a stacking direction. The stack tray 33 is supported by a suspended member 39 looped around a pair of winding pulleys 38*a* and 38*b*, which are arranged vertically onto the apparatus frame 36. A winding motor M1 is coupled to the winding pulley 38*a* and is configured to vertically move the stack tray 33 through forward and reverse rotation of the winding motor M1.

In order to position the stack tray 33 at a predetermined position through the vertical movement, there are provided a pulse generating portion, which is configured to generate a pulse in synchronization with drive of the winding motor M1, and a pulse counting portion (the pulse counting portion is included in a stack operation control portion 52) configured to count the number of pulses generated by the pulse generating portion. The stack tray 33 is moved to the predetermined position based on the number of pulses counted in the pulse counting portion. As another method, a timer configured to count drive time of the winding motor M1 may be used to move the stack tray 33 to the predetermined position based on the drive time of the winding motor M1, which is counted by the timer.

Figure 8:
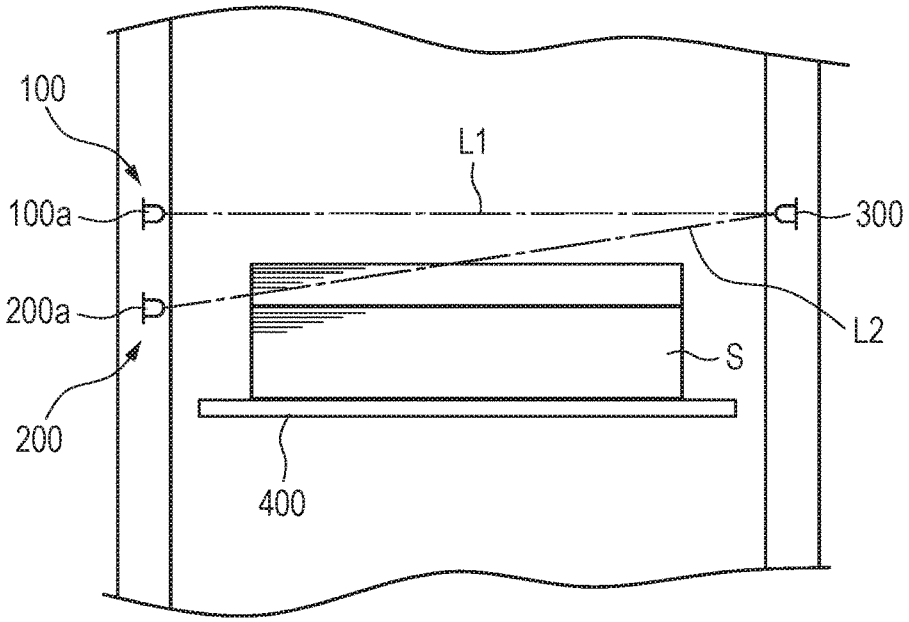
FIG. 8 is a front view of sensors and a stack tray in a related-art sheet stacking apparatus.
Figure 9A:
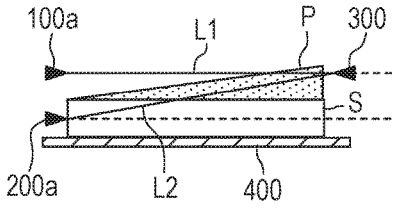
FIG. 9A, FIG. 9B, FIG. 9C, FIG. 9D, FIG. 9E, and FIG. 9F are explanatory views of a fault occurring during a raising and lowering operation of a stack tray according to the related art.
Figure 9B:
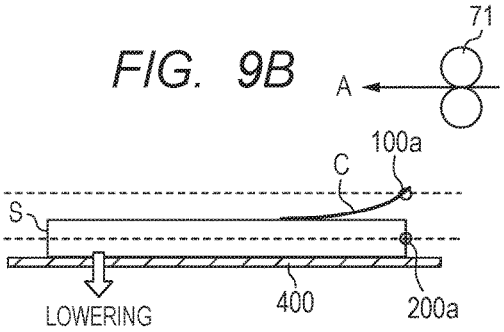
Figure 9C:
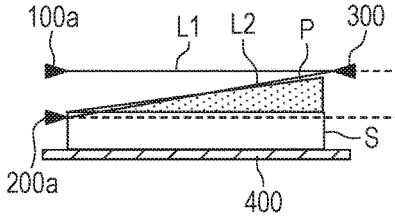
Figure 9D:
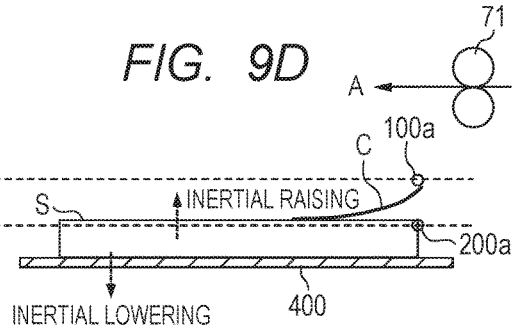
Figure 9E:
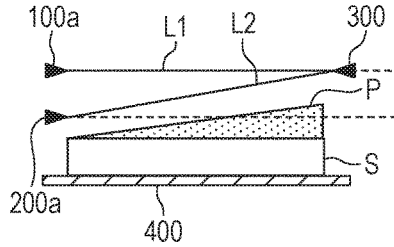
Figure 9F:
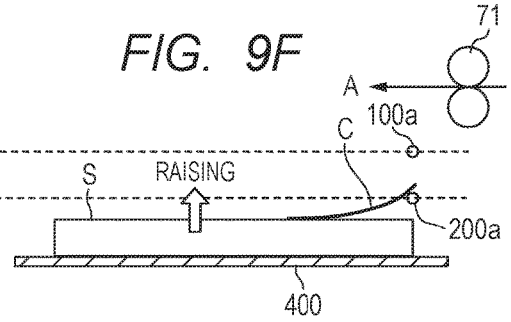

Sensors configured to detect two height levels of the sheets stacked on the stack tray 33 are arranged on the stack tray 33. The sensors are detecting portions serving as detectors configured to detect a position of a topmost sheet of the sheets stacked on the stack tray 33 by forming the optical axis L1 and the optical axis L2. The sensors are the same as the first sensor 100 and the second sensor 200 described referring to FIG. 8, and therefore are denoted by the same reference symbols in FIG. 3 so as to herein omit the description of configurations thereof.

As illustrated in FIG. 5A to FIG. 5H and FIG. 6A to FIG. 6H referred to later, a predetermined position is set between a height level H1 arranged on a horizontal line at which the light-receiving portion 100*a* of the sensor 100 and the light-emitting portion 300 are arranged and a height level H2 of a horizontal line passing through the light-receiving portion 200*a* of the sensor 200. The raising and lowering operation of the stack tray 33 is controlled so that the topmost sheet of the sheets stacked on the stack tray 33 is positioned at the predetermined position.

In addition to the conveyance passage 25, the processing tray 29, and the stack tray 33 described above, the sheet post-processing apparatus B illustrated in FIG. 2 further includes a second post-processing portion 41 communicating with a conveyance passage branching off from the conveyance passage 25 and a second stack tray 32 arranged on a downstream side of the second post-processing portion 41. The second post-processing portion 41 includes a stack guide 43 configured to stack the sheets sent from the conveyance passage 25, a saddle stitching stapler unit 44 configured to bind the aligned and stacked bundle of sheets, and folding rollers 45 configured to fold the bundle of sheets at a center portion thereof after the binding. After stacking the sheets conveyed from the conveyance passage 25 to perform bookbinding through the binding and the folding, the second post-processing portion 41 performs an operation of conveying the sheets to the second stack tray 32.

Figure 4:
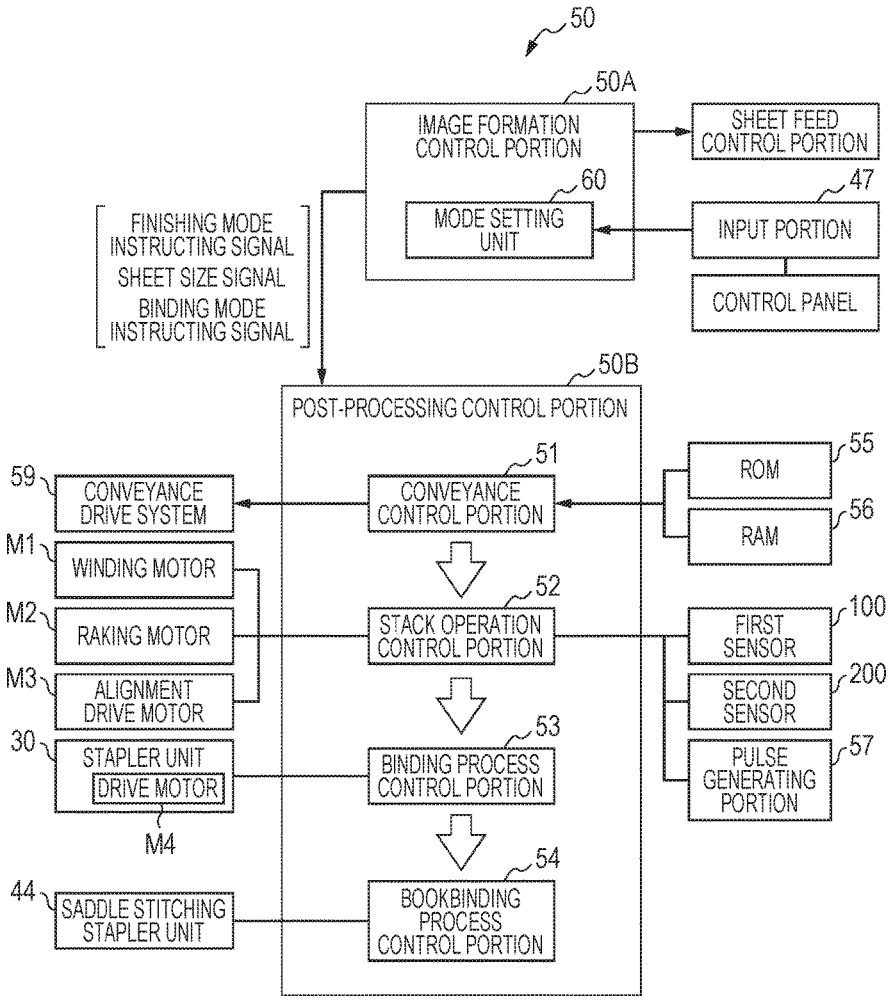
FIG. 4 is a block diagram for illustrating a controller.

A configuration of a controller 50 of the image forming apparatus 110 will be described referring to FIG. 4. The controller 50 includes an image formation control portion 50A and a post-processing control portion (control portion) 50B.

The image formation control portion 50A includes a mode setting portion 60 configured to set an image formation mode and a finishing mode. The finishing mode includes a binding process mode of aligning, stacking, and binding sheets on which images have been formed, a print-out mode of receiving the sheets on the stack tray 33 without binding, a jog reception mode of sorting and receiving sheets on which images have been formed, and a bookbinding process mode of performing bookbinding in the second post-processing portion 31. Any one of the above-mentioned modes is set as the finishing mode.

The image forming apparatus main body A includes an input portion 47 having a control panel (not shown) arranged therein. A user of the image forming apparatus main body A inputs a desired finishing mode, sheet size, and binding mode through the input portion 47. After the completion of the settings described above, the image formation control portion 50A indicates the contents of settings to the post-processing control portion 50B in the form of a finishing mode instructing signal, a sheet size signal, and a binding mode instructing signal.

The post-processing control portion 50B constructed of a CPU executes a control program stored in a ROM 55 to realize each of functions of a conveyance control portion 51, a stack operation control portion 52, a binding process control portion 53, and a bookbinding process control portion 54. In a RAM 56, data necessary for the execution of the control program is stored.

The conveyance control portion 51 is configured to control a conveyance drive system 59 including the conveyance rollers 28 arranged on the conveyance passage 25.

The stack operation control portion 52 is configured to control forward and reverse rotation of the winding motor M1 and switching between two rotation speeds of the winding motor M1. In this case, the winding motor M1 is controlled based on detection of interruption or opening of the optical axis L1 by the first sensor 100 and interruption or opening of the optical axis L2 by the second sensor 200.

Further, the stack operation control portion 52 is configured to control rotation of a raking motor M2 configured to drive a raking rotating body 46 configured to carry the sheets into the processing tray 29 and control rotation of an alignment drive motor M3 being a drive portion of an alignment member configured to align the sheets in a direction perpendicular to a sheet conveying direction so as to align and stack the sheets conveyed from the sheet delivery port 27 on the processing tray 29 during the execution of the binding process mode.

The binding process control portion 53 is configured to control a drive motor M4 of the stapler unit 30. A drive cam is coupled to the drive motor M4. Through rotation of the drive motor M4, a binding process with a staple is executed.

The bookbinding control portion 54 is configured to align and stack the sheets conveyed from the conveyance passage 25 on the stack guide 43, perform binding in the saddle stitching stapler unit 44, and then perform folding with the folding rollers 45. After the folding, the bookbinding control portion 54 conveys the bundle of sheets bound into a book to the second stack tray 32 by delivery rollers 72 and receives the bundle of sheets bound into the book on the second stack tray 32.

The sheet post-processing apparatus B includes an overflow tray 22 in addition to the first stack tray 33 and the second stack tray 32. On the overflow tray 22, a sheet that cannot be conveyed onto the first stack tray 33, for example, a sheet used in an interrupt printing mode or a large-size sheet is received. Therefore, the overflow tray 22 is arranged on an apparatus housing 49 so that a conveyance passage to the overflow tray 22 branches off from the conveyance passage 25.

In the image forming apparatus 110, when the binding process mode is instructed by the finishing mode instructing signal from the image formation control portion 50A, the binding is performed on the processing tray 29 so that the bound sheets are delivered to the stack tray 33 by delivery rollers 73. However, the bound sheets are sometimes stacked on the stack tray 33 in such a manner that edges of the bound sheets swell. Further, when the print-out mode of receiving the sheets on the stack tray 33 without binding is instructed, a rear edge of the sheet is sometimes curled during a process of image formation.

When the sheets, each having an uneven surface, are stacked on the stack tray 33, an erroneous operation that has been described in the "Description of the Related Art" section sometimes occurs. Specifically, when the first sensor 100 and the second sensor 200 detect the curled portion or the portion swelling through the binding, a loop operation in which the winding motor M1 repeats forward and reverse rotation is brought about.

Therefore, when the raising and lowering control for the stack tray 33 is performed, the post-processing control portion 50B appropriately switches the rotation speed of the forward and reverse rotation of the winding motor M1 between two rotation speeds, thereby preventing the erroneous operation described above.

FIG. 5A to FIG. 5H are views for illustrating a function of preventing the erroneous operation occurring when the curled portion of the sheet interrupts the optical axis L1 of the first sensor 100 on the stack tray 33. FIG. 5B, FIG. 5D, FIG. 5F, and FIG. 5H are side views of the stack tray 33 on which the sheets delivered in a direction indicated by the arrow A by the delivery rollers 73 are stacked. FIG. 5A, FIG. 5C, FIG. 5E, and FIG. 5G are front views of the stack tray 33 as viewed from a direction opposite to the direction indicated by the arrow A in FIG. 5B, FIG. 5D, FIG. 5F, and FIG. 5H.

Figure 5A:
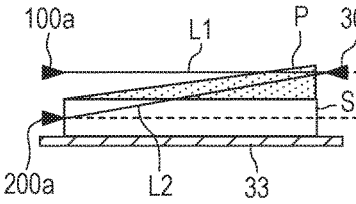
FIG. 5A, FIG. 5B, FIG. 5C, FIG. 5D, FIG. 5E, FIG. 5F, FIG. 5G, and FIG. 5H are explanatory views of a raising and lowering operation of the stack tray.
Figure 5B:
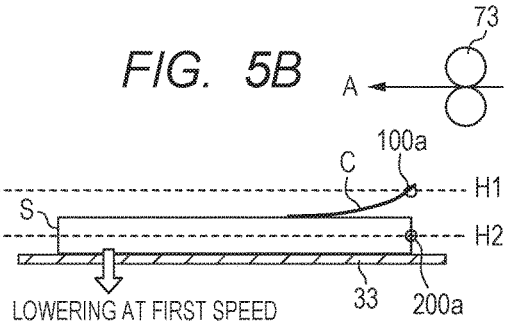

The post-processing control portion 50B controls the winding motor M1 so as to lower the stack tray 33 at a speed (first speed) that is normally used in this general type of sheet stacking apparatus when the sheets stacked on the stack tray 33 interrupt the optical axis L1 of the first sensor 100. Thus, when the sheet C having a curled rear edge is introduced, the curled portion interrupts the optical axis L1. Therefore, the post-processing control portion 50B lowers the stack tray 33 at the first speed (FIG. 5A and FIG. 5B).

Figure 5C:
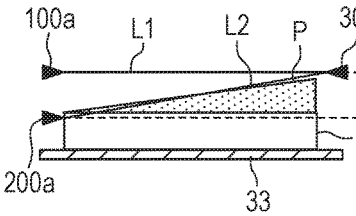
Figure 5D:
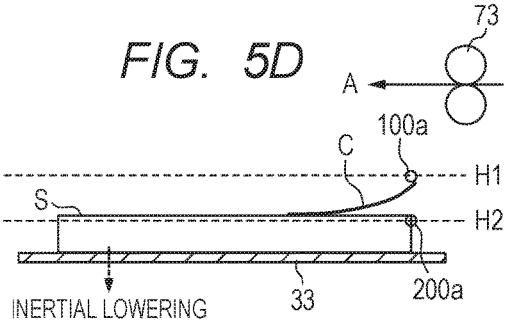
Figure 5E:
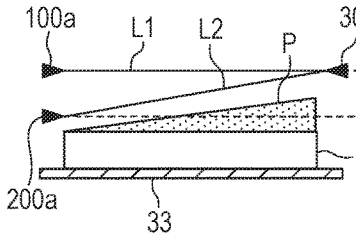
Figure 5F:
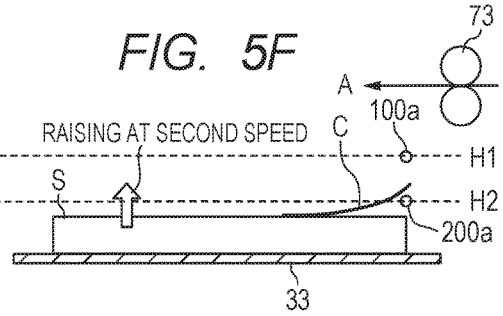

Then, when the curled portion deviates from the optical axis L1, the post-processing control portion 50B controls the winding motor M1 so as to stop the lowering of the stack tray 33 (FIG. 5C and FIG. 5D). At this time, however, the lowering is continued by inertia for a while. As a result, when the curled portion of the sheet C stacked horizontally on the stack tray 33 deviates from the optical axis L2 of the second sensor 200 (FIG. 5E and FIG. 5F), the post-processing control portion 50B controls the winding motor M1 so as to raise the stack tray 33.

Figure 5G:
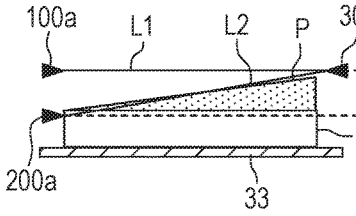
Figure 5H:
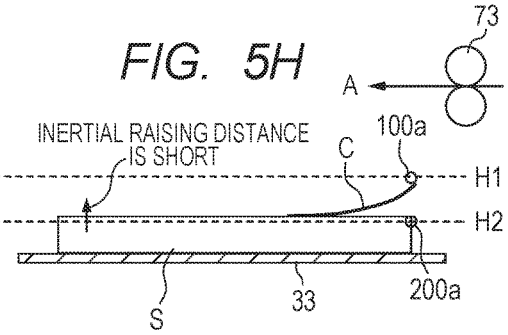

When the curled portion of the sheet interrupts the optical axis L2 as a result of the raising of the stack tray 33, the second sensor 200 is turned on so that the post-processing control portion 50B controls the winding motor M1 to stop the raising of the stack tray 33 (FIG. 5G and FIG. 5H). In this case, the winding motor M1 is rotating at a second speed corresponding to a low speed. Therefore, a distance over which the stack tray 33 continues to be raised by inertia even after the winding motor M1 is stopped is short. Thus, the curled portion stops before reaching the optical axis L1. Therefore, the curled portion does not interrupt the optical axis L1, and hence the loop operation in which the stack tray 33 is repeatedly lowered and raised is prevented.

FIG. 6A to FIG. 6H are views for illustrating a function of preventing the erroneous operation caused when the curled portion of the sheet interrupts the optical axis L2 of the second sensor 200 as a result of removal of the bundle of sheets from the stack tray 33. FIG. 6B, FIG. 6D, FIG. 6F, and FIG. 6H are side views of the stack tray 33 on which the sheets delivered in the direction indicated by the arrow A by the delivery rollers 73 are stacked. FIG. 6A, FIG. 6C, FIG. 6E, and FIG. 6G are front views of the stack tray 33 as viewed from a direction opposite to the direction indicated by the arrow A in FIG. 6B, FIG. 6D, FIG. 6F, and FIG. 6H.

Figure 6A:
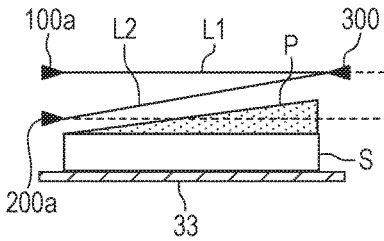
FIG. 6A, FIG. 6B, FIG. 6C, FIG. 6D, FIG. 6E, FIG. 6F, FIG. 6G, and FIG. 6H are explanatory views of a raising and lowering operation of the stack tray, which is different from that illustrated in FIG. 5A to FIG. 5H.
Figure 6B:
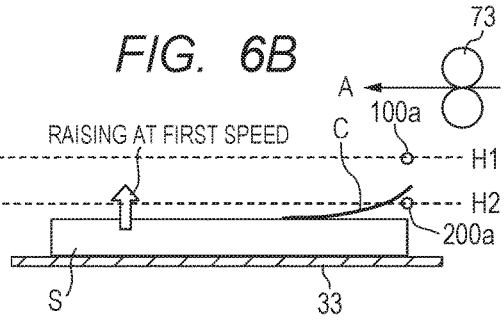
Figure 6C:
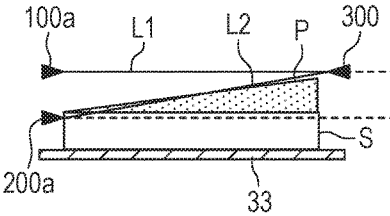
Figure 6D:
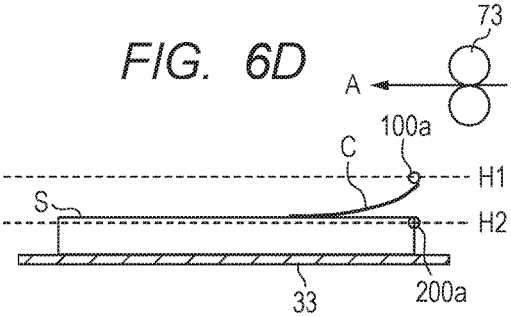

When the bundle of sheets is removed from the stack tray 33, the sheets stacked on the stack tray 33 deviate from the optical axis L2. Therefore, the post-processing control portion 50B drives the winding motor M1 at the first speed corresponding to a high speed to raise the stack tray 33 so as to quickly return an upper surface level of the sheets on the stack tray 33 to a previous level (FIG. 6A and FIG. 6B).

Figure 6E:
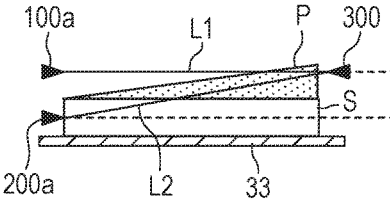
Figure 6F:
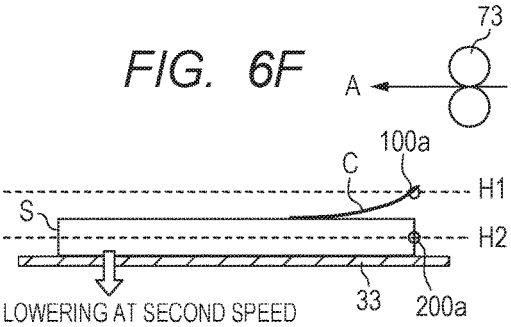

Then, even when the winding motor M1 is stopped at the time of interruption of the optical axis L2 of the second sensor 200 with the curled portion as a result of the raising of the stack tray 33 (FIG. 6C and FIG. 6D), the triangular interruption region P is generated in a case where the sheet C having a curled portion is introduced to the stack tray 33. Thus, timing of interruption of the optical axis L2 being an oblique line is delayed. Thus, the curled portion sometimes interrupts the optical axis L1 (FIG. 6E and FIG. 6F).

Figure 6G:
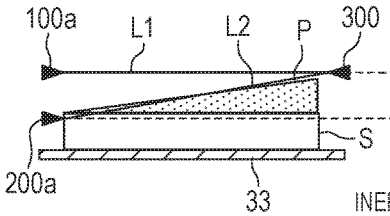
Figure 6H:
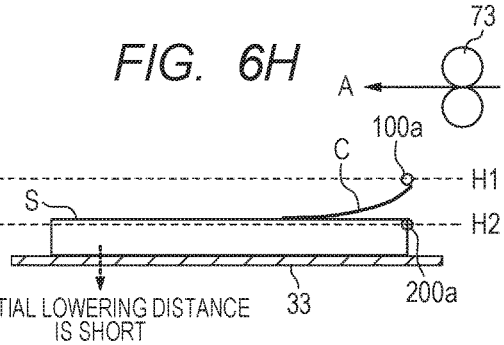

In this case, the post-processing control portion 50B controls the drive of the winding motor M1 so as to lower the stack tray 33 at the second speed corresponding to the low speed. As a result, even when the drive of the winding motor M1 is stopped based on the deviation of the curled portion from the optical axis L1, the stack tray 33 is lowered at the second speed and therefore a distance of movement by inertia is short. Therefore, the stack tray 33 is stopped without the interruption of the optical axis L2 with the curled portion (FIG. 6G and FIG. 6H). Thus, the curled portion does not interrupt the optical axis L2. Hence, the loop operation in which the stack tray 33 is repeatedly raised and lowered is prevented.

Stack tray raising and lowering control performed by the post-processing control portion 50B will be described referring to the flowcharts of FIG. 7A and FIG. 7B.

Figure 7A:
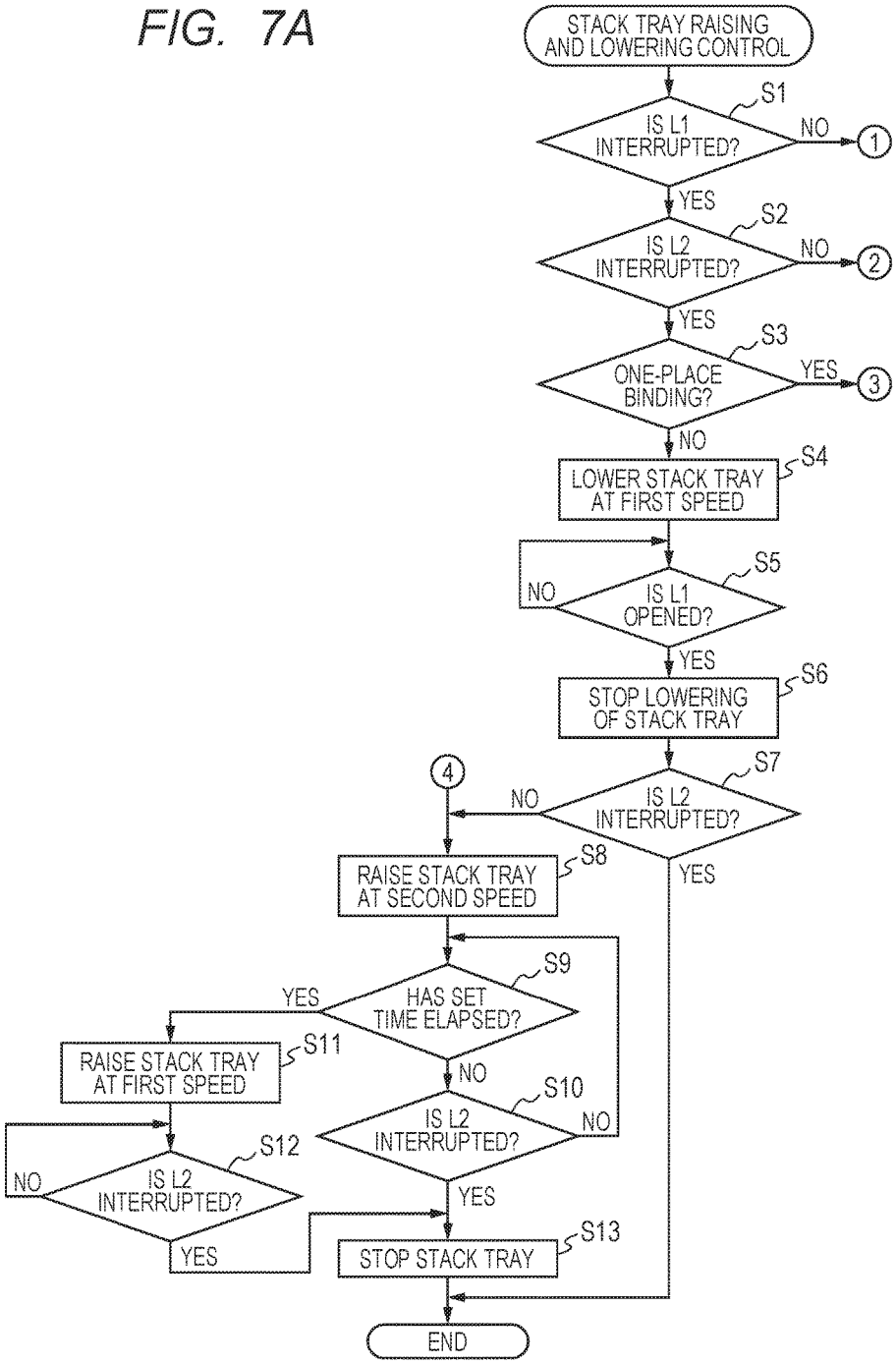
FIG. 7A is a flowchart of a control operation for performing the raising and lowering operation of the stack tray.

In FIG. 7A, after starting the stack tray raising and lowering control, the post-processing control portion 50B detects whether or not the stacked sheets on the stack tray 33 interrupt the optical axis L1 of the first sensor 100 (Step S1).

When the interruption of the optical axis L1 of the first sensor 100 is detected in Step S1 ("YES" in Step S1), the post-processing control portion 50B then detects whether or not the optical axis L2 of the second sensor 200 is interrupted (Step S2). At this time, when the upper surface of the stacked sheets on the stack tray 33 interrupts the optical axis L2 ("YES" in Step S2), the post-processing control portion 50B determines whether or not the sheets processed on the processing tray 29 immediately before the detection of the interruption of the optical axis L1 are sheets that are instructed to be bound at one place in response to the binding mode instructing signal from the image formation control portion 50A (Step S3). When the result in Step S1 is "NO", the processing performed by the post-processing control portion 50B proceeds to Step S20. When the result in Step S2 is "NO", the processing performed by the post-processing control portion 50B proceeds to Step S21. When the result in Step S3 is "YES", specifically, it is supposed that the sheets stacked on the stack tray 33 are in a state in which the topmost sheet is incapable of being positioned at a predetermined position (state in which the optical axis L1 is not interrupted but the optical axis L2 is interrupted) when the stack tray 33 is moved at the first speed, the processing performed by the post-processing control portion 50B proceeds to Step S26. The case where "the sheets stacked on the stack tray 33 are in a state in which the topmost sheet is incapable of being positioned at the predetermined position (state in which the optical axis L1 is not interrupted but the optical axis L2 is interrupted) when the stack tray 33 is moved at the first speed" includes a case of an environmental state in which the curl is likely to occur (for example, at a predetermined temperature or higher and a predetermined humidity or higher) without being limited to the above-mentioned case.

In this case, when the binding at one place is not instructed, drive control of the winding motor M1 at the first speed is started so as to lower the stack tray 33 (Step S4). Then, the post-processing control portion 50B waits until the interruption of the optical axis L1 is cancelled so as to open the optical axis L1 by the lowering of the sheets (Step S5).

When the sheets on the stack tray 33 being lowered deviate from the optical axis L1 to open the optical axis L1 ("YES" in Step S5), the post-processing control portion 50B stops the drive of the winding motor M1 to stop the lowering of the stack tray 33 (Step S6). At this time, when the optical axis L2 of the second sensor 200 is interrupted ("YES" in Step S7), the post-processing control portion 50B ends the stack tray raising and lowering control.

On the other hand, when the optical axis L2 is opened ("NO" in Step S7), the post-processing control portion 50B starts the drive control of the winding motor M1 so as to raise the stack tray 33.

At this time, it is when the topmost sheet of the stacked sheets is positioned below a predetermined position H by inertia as described referring to FIG. 5A to FIG. 5H that the optical axis L2 switched to be opened is detected in Step S7 after the detection of the interruption of the optical axis L2 in Step S2.

Thus, the post-processing control portion 50B controls the drive of the winding motor M1 so as to raise the stack tray 33 at the second speed corresponding to the low speed (Step S8). At this time, the post-processing control portion 50B starts a timer operation after starting the drive of the winding motor M1.

Then, the post-processing control portion 50B determines whether or not set time has elapsed (Step S9). When the set time has not elapsed, whether or not the optical axis L2 of the second sensor 200 is interrupted is detected (Step S10). When the optical axis L2 is not interrupted, the processing returns to Step S9. Therefore, when the optical axis L2 of the second sensor 200 is not interrupted by the stacked sheets on the stack tray 33 before the set time from the start of the raising of the stack tray 33 elapses, the processing in Step S9 and the processing in Step S10 are repeated. Then, when the optical axis L2 is interrupted before the set time elapses ("YES" in Step S10), the post-processing control portion 50B stops the drive of the winding motor M1 to stop the raising and lowering of the stack tray 33 (Step S13). Therefore, the topmost sheet of the sheets stacked on the stack tray 33 is positioned between the height level H1 and the height level H2.

Therefore, in a case where the sheet C having the curled edge is introduced to the stack tray 33, even when the stack tray 33 is raised by the amount of inertia even after the stop of the winding motor M1, the stack tray 33 is raised at the second speed corresponding to the low speed. Therefore, the optical axis L1 is not interrupted again by the curled portion due to the inertial movement, and hence the loop operation is inhibited.

Through the flow of the processing from Step S4 to Step S10 and Step S13, the operation of preventing the fault described referring to FIG. 5A to FIG. 5H, which may occur when the sheet C having the curled edge is introduced to the stack tray 33, is performed.

When the bundle of sheets is removed from the stack tray 33, the optical axis L2 is sometimes not interrupted before the set time elapses ("YES" in Step S9). In this case, the post-processing control portion 50B controls the drive of the winding motor M1 so as to switch the stack tray 33 to be raised at the first speed corresponding to the high speed (Step S11), and waits until the optical axis L2 is interrupted (Step S12). Then, after the optical axis L2 is interrupted, the processing proceeds to Step S13 where the drive of the winding motor M1 is stopped. Then, the raising and lowering control for the stack tray 33 is ended. In this manner, when the bundle of sheets is removed, the stack tray 33 is raised at the first speed. As a result, the topmost sheet of the sheets stacked on the stack tray 33 can be quickly positioned between the height level H1 and the height level H2.

Figure 7B:
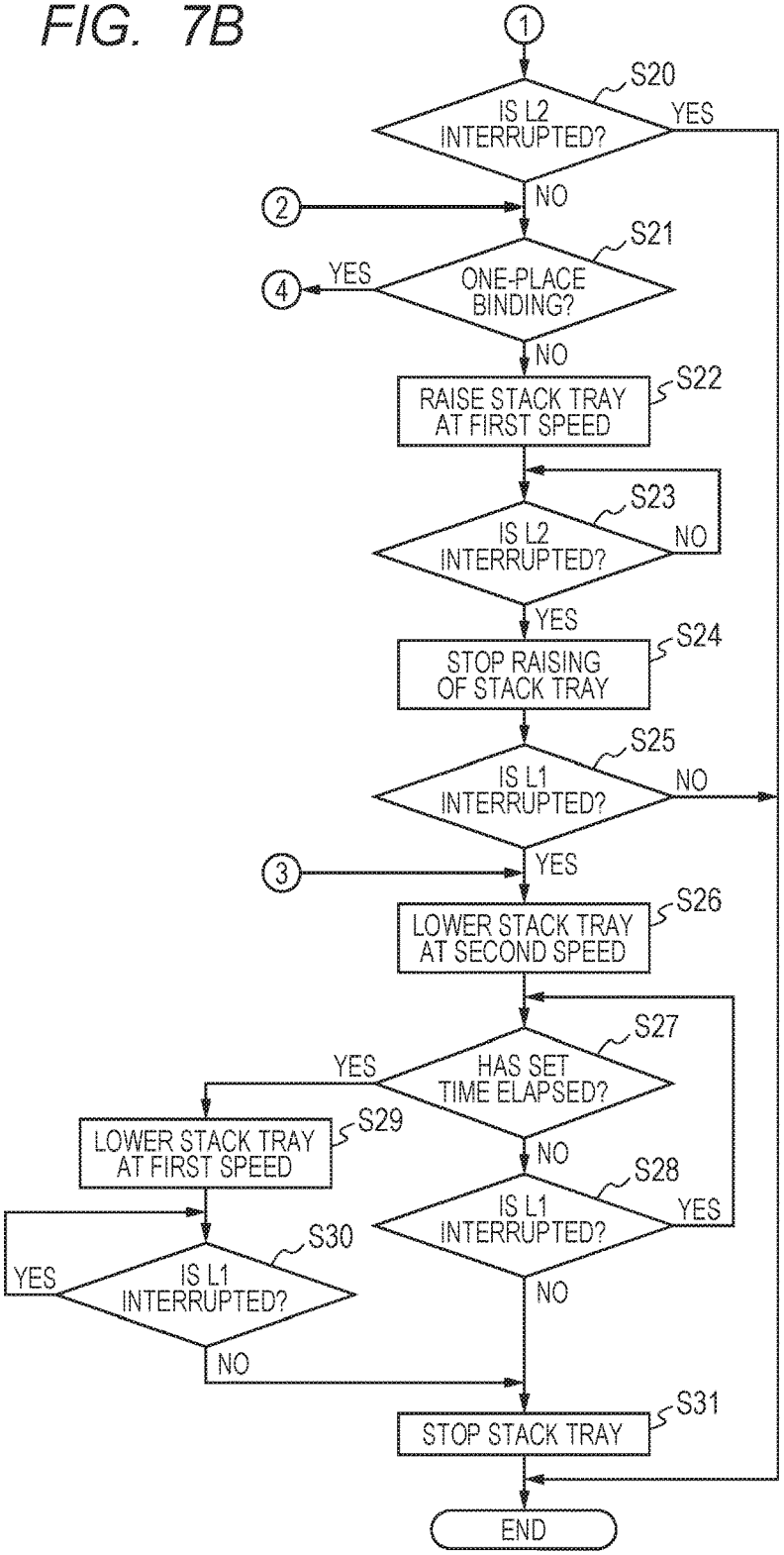
FIG. 7B is a flowchart subsequent to FIG. 7A.

Returning to the description of the processing in Step S1, when the optical axis L1 is opened ("NO" in Step S1), processing illustrated in the flowchart of FIG. 7B is performed. The post-processing control portion 50B detects whether or not the optical axis L2 of the second sensor 200 is interrupted (Step S20). At this time, when the optical axis L2 is interrupted, the post-processing control portion 50B ends the stack tray raising and lowering control.

On the other hand, when the post-processing control portion 50B detects that the optical axis L2 is opened ("NO" in Step S20), it is determined whether or not the sheets processed on the processing tray 29 immediately before the detection of the uninterrupted state of the optical axis L2 are sheets that are bound at one place (Step S21). When the binding at one place is not instructed by the image formation control portion 50A, the post-processing control portion 50B starts the drive control of the winding motor M1 so that the stack tray 33 is raised at the first speed (Step S22), and waits until the optical axis L2 is interrupted by the sheets stacked on the stack tray 33 (Step S23).

Then, when the optical axis L2 is interrupted as a result of the raising of the stack tray 33, the post-processing control portion 50B stops the drive of the winding motor M1 to stop the raising of the stack tray 33 (Step S24). Then, the post-processing control portion 50B detects whether or not the optical axis L1 is interrupted (Step S25). When the optical axis L1 is not interrupted ("NO" in Step S25), the stack tray raising and lowering control is ended. The flow of the processing from Step S1 and Step S20 to "NO" in Step S25 described above is an operation of raising the stack tray 33 so that the topmost sheet of the remaining sheets after the bundle of sheets is removed from the stack tray 33 is positioned between the height level H1 and the height level H2.

When detecting that the optical axis L1 is interrupted ("YES" in Step S25), the post-processing control portion 50B starts the drive control of the winding motor M1 so that the stack tray 33 is lowered at the second speed corresponding to the low speed (Step S26). In this case, the post-processing control portion 50B starts the timer operation after starting the drive of the winding motor M1. Therefore, the post-processing control portion 50B determines whether or not the set time has elapsed (Step S27). When the set time has not elapsed, the post-processing control portion 50B detects whether or not the optical axis L1 of the first sensor 100 is interrupted (Step S28). When the optical axis L1 is interrupted, the processing returns to Step S27.

Therefore, while the optical axis L1 of the first sensor 100 is interrupted by the stacked sheets on the stack tray 33 before the set time from the start of the lowering of the stack tray 33 elapses, the post-processing control portion 50B repeats the processing in Step S27 and the processing in Step S28.

Then, when detecting that the optical axis L1 is opened, the post-processing control portion 50B stops the drive of the winding motor M1 to stop the raising and lowering of the stack tray 33 (Step S31). Thus, the topmost sheet of the sheets stacked on the stack tray 33 is positioned between the height level H1 and the height level H2.

Through the flow of the processing from Step S22 to Step S28 and Step S31, the operation of preventing the fault described referring to FIG. 6A to FIG. 6H when the sheet C having the curled edge is introduced to the stack tray 33 is performed.

When the optical axis L1 is not opened before the set time elapses ("YES" in Step S27), however, the post-processing control portion 50B controls the drive of the winding motor M1 so as to switch the stack tray 33 to be lowered at the first speed higher than the second speed (Step S29), and waits until the optical axis L1 is opened (Step S30). Then, when the optical axis L1 is opened, the processing proceeds to Step S31 where the drive of the winding motor M1 is stopped. Then, the stack tray raising and lowering control is ended.

In the manner described above, when a large amount of sheets are stacked on the stack tray 33, the switching is performed so that the stack tray 33 is lowered at the first speed. As a result, the topmost sheet of the sheets stacked on the stack tray 33 can be quickly positioned between the height level H1 and the height level H2.

In the flowcharts of FIG. 7A and FIG. 7B, when the post-processing control portion 50B determines in Step S3 that the binding at one place is instructed by the image formation control portion 50A, the processing proceeds to Step S26. Although a specific description thereof is herein omitted, the binding process control portion 53 controls an edge binding staple of the stapler unit 30 to bind the sheets at one place in the post-processing control portion 50B when the binding at one place is instructed by the image formation control portion 50A. However, the sheets bound at one place have a size difference between a height of edges on a bound side and a height of edges on an unbound side, resulting in swelling of the sheet surface.

When the interruption of both of the optical axis L1 and the optical axis L2 by the sheets bound at one place is detected in each of Step S1 and Step S2, the post-processing control portion 50B performs the processing from Step S26 to Step S31 described above to control the lowering operation of the stack tray 33 so that the topmost sheet of the sheets stacked on the stack tray 33 is positioned between the height level H1 and the height level H2.

When the post-processing control portion 50B determines in Step S21 that the binding at one place is instructed by the image formation control portion 50A, the processing proceeds to Step S8. The processing proceeds to Step S8 when it is detected in each of Step S1 and Step S20 that both the optical axis L1 and the optical axis L2 are opened or it is detected that the optical axis L1 is interrupted in S1 and that the optical axis L2 is opened in S2. The post-processing control portion 50B performs the processing from Step S8 to Step S13 described above to control the raising operation of the stack tray 33 so that the topmost sheet of the sheets stacked on the stack tray 33 is positioned between the height level H1 and the height level H2.

According to the sheet stacking apparatus of the embodiment, it is possible to suppress the fault in the raising and lowering operation of the stack portion even when the sheet is detected by the first optical axis and the second optical axis inclined at a predetermined angle with respect to the first optical axis.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-026094, filed Feb. 15, 2016, which is hereby incorporated by reference herein in its entirety.

What is claimed is:

1. A sheet stacking apparatus, comprising:

a stacker, which is movable and on which sheets are to be stacked;

a raising and lowering portion configured to raise and lower the stacker;

a sheet detector configured to detect whether or not a topmost sheet of sheets stacked on the stacker is positioned at a predetermined position in accordance with whether or not a first optical axis formed by the sheet detector is interrupted by a sheet and whether or not a second optical axis formed by the sheet detector and inclined at a predetermined angle with respect to the first optical axis is interrupted by a sheet; and a control portion configured to cause the raising and lowering portion to position a topmost sheet of sheets stacked on the stacker at the predetermined position based on a detection result of the sheet detector, wherein in a case where the control portion causes the raising and lowering portion to move the stacker at a first speed so that a topmost sheet of sheets stacked on the stacker deviates from the predetermined position, the control portion causes the raising and lowering portion to move the stacker at a second speed lower than the first speed to position the topmost sheet at the predetermined position.

2. A sheet stacking apparatus according to claim 1, further comprising:

a motor configured to drive the stacker; and a pulse generator configured to generate a pulse in synchronization with a drive of the motor, wherein the control portion comprises a pulse counter configured to count a number of pulses generated from the pulse generator, and wherein the control portion causes the raising and lowering portion to move the stacker to the predetermined position based on the number of pulses counted by the pulse counter.

3. An image forming apparatus, comprising:

an image former configured to form an image on a sheet; and a sheet stacking apparatus as recited in claim 2, the sheet stacking apparatus being configured to stack the sheet on which the image has been formed by the image former.

4. A sheet stacking apparatus according to claim 1, wherein the raising and lowering portion comprises a motor configured to drive the stacker, wherein the control portion comprises a timer configured to count a drive time of the motor, and wherein the control portion causes the raising and lowering portion to move the stacker to the predetermined position based on the drive time of the motor counted by the timer.

5. An image forming apparatus, comprising:

an image former configured to form an image on a sheet; and a sheet stacking apparatus as recited in claim 4, the sheet stacking apparatus being configured to stack the sheet on which the image has been formed by the image former.

6. An image forming apparatus, comprising:

an image former configured to form an image on a sheet; and a sheet stacking apparatus as recited in claim 1, the sheet stacking apparatus being configured to stack the sheet on which the image has been formed by the image former.

7. A sheet stacking apparatus, comprising:

a stacker, which is movable and on which sheets are to be stacked;

a raising and lowering portion configured to raise and lower the stacker;

a sheet detector configured to detect whether or not a topmost sheet of sheets stacked on the stacker is positioned at a predetermined position in accordance with whether or not a first optical axis formed by the sheet detector is interrupted by a sheet and whether or not a second optical axis formed by the sheet detector and inclined at a predetermined angle with respect to the first optical axis is interrupted by a sheet; and a control portion configured to cause the raising and lowering portion to position a topmost sheet of sheets stacked on the stacker at the predetermined position based on a detection result of the sheet detector, wherein the control portion executes a first mode of causing the raising and lowering portion to move the stacker at a first speed to position a topmost sheet of sheets stacked on the stacker at the predetermined position and a second mode of, in a case where sheets stacked on the stacker are in a state in which a topmost sheet of the sheets is incapable of being positioned at the predetermined position when the stacker is moved at the first speed, causing the raising and lowering portion to move the stacker at a second speed lower than the first speed to position the topmost sheet of the sheets stacked on the stacker at the predetermined position.

8. An image forming apparatus, comprising:

an image former configured to form an image on a sheet; and a sheet stacking apparatus as recited in claim 7, the sheet stacking apparatus being configured to stack the sheet on which the image has been formed by the image former.

9. A sheet stacking apparatus, comprising:

a stacker on which delivered sheets are to be stacked;

a raising and lowering portion configured to raise and lower the stacker;

a sheet detector configured to detect a sheet stacked on the stacker; and a control portion configured to control the raising and lowering portion based on a detection result of the sheet detector so that a height level of a surface of a topmost sheet of sheets stacked on the stacker is positioned at a predetermined position set in advance, wherein the sheet detector comprises:

a light-emitting portion arranged at a predetermined height level on a side of one side surface of the stacker;

a first light-receiving portion, which is arranged at a position corresponding to the predetermined height level on a side of another side surface of the stacker, and is configured to detect whether or not a first optical axis from the light-emitting portion is interrupted by a sheet stacked on the stacker; and a second light-receiving portion configured to detect whether or not a second optical axis inclined downward at a predetermined angle with respect to the first optical axis from the light-emitting portion is interrupted by a sheet stacked on the stacker, wherein the control portion controls the raising and lowering portion so that the first light-receiving portion detects "absence of sheet" and the second light-receiving portion detects "presence of sheet", and wherein, in a case where a detection result of the first light-receiving portion is changed from the "absence of sheet" to the "presence of sheet", the control portion lowers the stacker at a first speed set in advance through a detection result of the "absence of sheet" by the first light-receiving portion further toward the predetermined position, and thereafter in a case where a detection result of the second light-receiving portion is changed from the "presence of sheet" to the "absence of sheet", the control portion raises the stacker at a second speed lower than the first speed to position a topmost sheet of sheets on the stacker at the predetermined position.

10. An image forming apparatus, comprising:

an image former configured to form an image on a sheet; and a sheet stacking apparatus as recited in claim 9, the sheet stacking apparatus being configured to stack the sheet on which the image has been formed by the image former.

11. A sheet stacking apparatus, comprising:

a stacker on which delivered sheets are to be stacked;

a raising and lowering portion configured to raise and lower the stacker;

a sheet detector configured to detect a sheet stacked on the stacker; and a control portion configured to control the raising and lowering portion based on a detection result of the sheet detector so that a height level of a surface of a topmost sheet of sheets stacked on the stacker is positioned at a predetermined position set in advance, wherein the sheet detector comprises:

a light-emitting portion arranged at a predetermined height level on a side of one side surface of the stacker;

a first light-receiving portion, which is arranged at a position corresponding to the predetermined height level on a side of another side surface of the stacker, and is configured to detect whether or not a first optical axis from the light-emitting portion is interrupted by a sheet stacked on the stacker; and a second light-receiving portion configured to detect whether or not a second optical axis inclined downward at a predetermined angle with respect to the first optical axis from the light-emitting portion is interrupted by a sheet stacked on the stacker, wherein the control portion controls the raising and lowering portion so that the first light-receiving portion detects "absence of sheet" and the second light-receiving portion detects "presence of sheet", and wherein, in a case where a detection result of the second light-receiving portion is changed from the "presence of sheet" to the "absence of sheet", the control portion raises the stacker at a first speed set in advance through a detection result of the "presence of sheet" by the second light-receiving portion further toward the predetermined position, and thereafter in a case where a detection result of the first light-receiving portion is changed from the "absence of sheet" to the "presence of sheet", the control portion lowers the stacker at a second speed lower than the first speed to position a topmost sheet of sheets on the stacker at the predetermined position.

12. An image forming apparatus, comprising:

an image former configured to form an image on a sheet; and a sheet stacking apparatus as recited in claim 11, the sheet stacking apparatus being configured to stack the sheet on which the image has been formed by the image former.

13. A sheet stacking apparatus, comprising:

a stacker, which is movable and on which sheets are to be stacked;

a stapler configured to perform a binding process on a sheet;

a raising and lowering portion configured to raise and lower the stacker;

a sheet detector configured to detect whether or not a topmost sheet of sheets stacked on the stacker is positioned at a predetermined position in accordance with whether or not a first optical axis formed by the sheet detector is interrupted by a sheet and whether or not a second optical axis formed by the sheet detector and inclined at a predetermined angle with respect to the first optical axis is interrupted by a sheet; and a control portion configured to cause the raising and lowering portion to position a topmost sheet of sheets stacked on the stacker at the predetermined position based on a detection result of the sheet detector, wherein the control portion executes a first mode of causing the raising and lowering portion to move the stacker at a first speed to position a topmost sheet of sheets stacked on the stacker at the predetermined position and a second mode of, in a case where a sheet on which the binding process has been performed by the stapler is a topmost sheet of sheets stacked on the stacker, causing the raising and lowering portion to move the stacker at a second speed lower than the first speed to position the topmost sheet of the sheets stacked on the stacker at the predetermined position.

* * * * *